United States Patent [19]

Phillips

[11] 4,268,824

[45] May 19, 1981

[54] PLANT SOIL MOISTURE LEVEL-SIGNALING DEVICE FOR HOUSEHOLD AND COMMERCIAL USE

[76] Inventor: Reed E. Phillips, 220-55 46th Ave., Bayside, N.Y. 11361

[21] Appl. No.: 29,766

[22] Filed: Apr. 13, 1979

Related U.S. Application Data

[63] Continuation of Ser. No. 859,037, Dec. 9, 1977, abandoned.

[51] Int. Cl.[3] ..... G08B 21/00

[52] U.S. Cl. ..... 340/604; 324/65 R; 324/65 P; 340/602

[58] Field of Search ..... 340/602, 604, 605, 620; 324/65 R, 65 P; 73/40, 40.3, 73, 304 R; 200/61.04, 61.05, 61.06

[56] References Cited

U.S. PATENT DOCUMENTS

| | | | |
|---|---|---|---|
| 3,197,699 | 7/1965 | Johansen | 340/604 X |
| 3,335,334 | 8/1967 | Albisser | 340/620 X |
| 3,636,509 | 1/1972 | Breece et al. | 340/620 X |
| 3,644,885 | 2/1972 | Radin | 340/620 X |
| 3,979,667 | 9/1976 | Cornes | 324/65 R |
| 4,020,417 | 4/1977 | Brehob et al. | 324/65 R |
| 4,122,389 | 10/1978 | Haagen | 340/604 X |

*Primary Examiner*—John W. Caldwell, Sr.
*Assistant Examiner*—Daniel Myer
*Attorney, Agent, or Firm*—Bauer & Amer

[57] ABSTRACT

A battery-powered device useful in supervising the progressive loss over a time interval of moisture in the soil of a household plant from an initial growth-promoting level to a diminished level at which replenishment is required, wherein the device has a continuously inserted, operative position in the plant soil throughout said time interval of supervision, and yet does not require frequent change of its powering batteries.

3 Claims, 4 Drawing Figures

PLANT SOIL MOISTURE LEVEL-SIGNALING DEVICE FOR HOUSEHOLD AND COMMERCIAL USE

This is a continuation of application Ser. No. 859,037 filed on Dec. 9, 1977, now abandoned.

The present invention relates generally to a signaling device for indicating when a household plant should be watered, and more particularly to an improved plant soil moisture level indicator characterized by its simplicity of construction, low cost, and convenience in use.

There are currently available several types of electronic signaling devices which, related to plant care, have as their objective the prevention of overwatering and underwatering of plants, the most common sources for plant death and failure to thrive among amateur plant growers. These devices fall into two main categories. The first employs a microammeter connected across a bimetallic corrosion resistant probe which produces a small current when the probe tip is exposed to moisture in the soil and its dissolved fertilizer. In essence, the probe acts as a battery producing a current deflecting the needle of the meter. Its advantages include no battery requirement, an arrangement that is inherently self-powered and re-usable over an extended period of time, and the ability to estimate, although very inaccurately, the degree of moisture in the soil. However, the noted device cannot be left in the soil, but must be moved from plant to plant, and requires the owner to remember to test his plants at certain times, necessitating either watering test schedules, or testing every plant every day—a time consuming process. This type device also typically is expensive, the principal portion of the cost being the expensive meter which is also subject to damage.

The second type of device uses an LED, or light emitting diode, in series with a 9 volt transistor battery and a two-pronged probe. When the soil is wet, the resistance between the probe prongs decreases, allowing current to flow through the LED from the battery. It is inferior to and more inaccurate than the first device, suffering from all of the disadvantages of the former, and in addition, requires its own battery. It is also expensive. Furthermore, both of the above devices destroy the root system of a plant and introduce undesirable bacteria into the soil as the probes are repeatedly inserted into the soil.

There are also commercially available cheap devices costing less than one dollar, that are non-electronic and are permanently placed in the soil. They work either by a chemical dye turning color from pink to blue in the presence of moisture, or by a dark green piece of plastic turning a lighter green in the absence of moisture. However, these devices suffer from poor visibility, are highly inaccurate, and have a short operating lifetime. Because these chemical dye devices rely on capillary action that passively transports moisture from the soil to the sensing area of the device, they are subject to corrosion and precipitation of salts and fertilizer within the device, an operating parameter which effectively destroys accuracy and usability.

Broadly, it is an object of the present invention to provide an improved moisture level supervising device for household plant soil overcoming the foregoing and other shortcomings of the prior art. Specifically, it is an object to use a powering battery for the device, eliminating the inadequacies of chemical dyes, and yet produce the device economically, and also enable its use in a continuously inserted operative position in the soil it is supervising, all as will be explained in detail subsequently.

A household plant device for signaling dryness in the soil thereof demonstrating objects and advantages of the present invention includes a battery-operated so-called LED signaling light having "on" and "off" operating modes. Cooperating therewith is a moisture-sensing electrical switch in the form of a probe extending in depending relation from the device and having an operative inserted position in said plant soil continuously for the duration of the time interval that it takes for an assumed initially normally high moisture level of the plant soil, which is electrically effective to cause a corresponding closed condition in the switch, to diminish to the point where there is nominal electrical conductivity. At this stage, the switch automatically assumes an open condition in response to said diminishment of the plant soil moisture level. The then "open" switch is embodied in a control circuit that is electrically connected to produce the "on" operating mode in the LED signaling light. Thus, the within device is normally virtually not being battery-powered since the plant soil is normally moist, and this operating mode thus contributes to an effective long duration of operational use without any need to make frequent changes of the batteries.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 4:
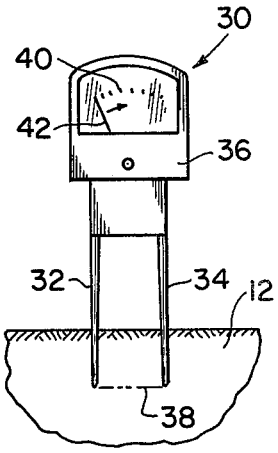
PRIOR ART FIG.4

Remaining FIG. 4 is a front elevational view of a typical prior art moisture indicator which by comparing the mode of operation thereof with that of the within inventive device enhances an understanding of said inventive device.

Figure 1:
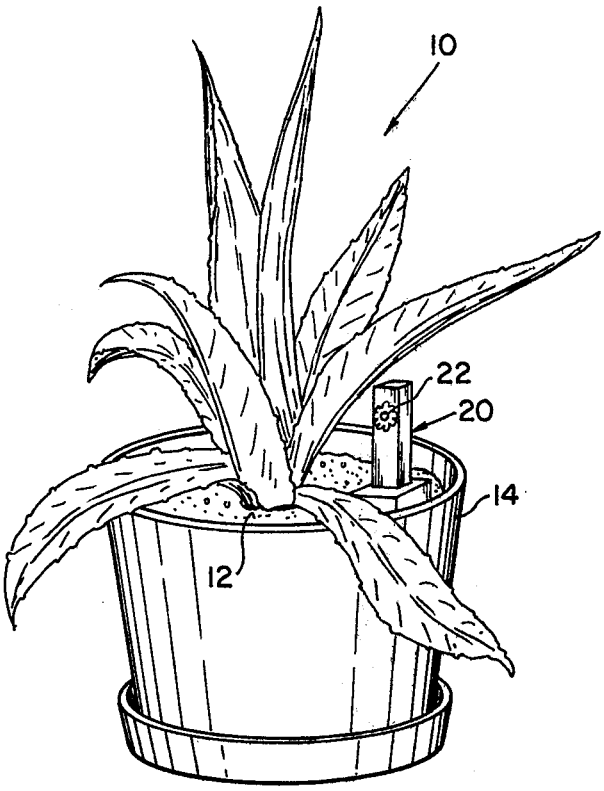
FIG. 1 is a perspective view of a household plant illustrating the operative inserted position of the within moisture level signaling device in the soil of said plant.
Figure 2:
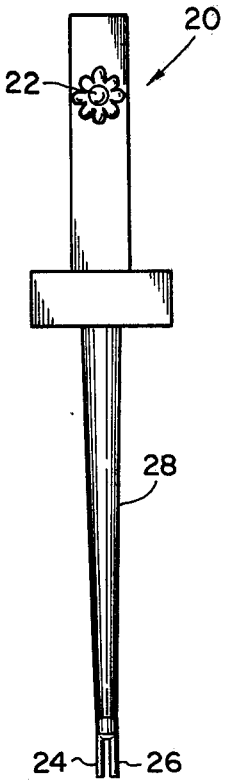
FIG. 2 is an isolated front elevational view of an exemplary physical embodiment of the within signaling device.

Underlying the present invention is the recognition that the care of a household plant, i.e. a plant that is located indoors, is primarily one in which the moisture content of the soil for the plant after a period of time requires replenishment, rather than the plant being vulnerable to the adverse effects of too much soil moisture. That is, since a typical household plant, generally designated 10 in FIG. 1, is grown indoors in soil 12 contained within a flower pot 14, it does not have the benefit of natural rainfall, dew, or other sources of moisture. Instead, starting from an initial moisture level, which can be assumed to be appropriate and favorable for the growth of the plant 10, said moisture level will by virtue of the mere passage of time diminish, not only due to nourishment of the plant 10 but also due to evaporation and other such causes of moisture loss, and will therefore require the addition of water, and thus the restoration to a higher favorable moisture level. The aforesaid is advantageously related to the mode of operation of the within signaling device, herein generally designated 20. More particularly, and as will be described in detail subsequently, device 20, as clearly illustrated in FIG. 1, has an operative inserted position within the soil 12 which is continuous for the entire length of time that it monitors or supervises the moisture content of the soil 12. Stated more directly, device 20 is intended to be placed in the soil 12 and to continuously remain therein in order to achieve its objective of signaling to the user, preferably by the blinking of a light 22, when the initially favorable moisture content of the soil 12 has receded, or dried out, to the point where additional water should be added. Of additional benefit, by avoiding watering of the plant before the within device signals a low moisture level, the user avoids the possibility of watering the plant when it doesn't require it, a condition known as over watering, which may result in rotting of the plant's root system with consequent injury being possible death to the plant itself.

In sharp contrast to the mode of operation of the device 20 as generally described up to this point, the typical prior art moisture-supervising device, generally designated 30 in FIG. 4, does not have an operative inserted position in the plant soil which it is supervising for the time duration of this supervision. Rather, the contemplated use of device 30 is one in which it is only temporarily inserted in the plant soil for the purpose of registering, during its short interval of contact with said soil, the moisture content of the soil. To this end, the prior art device 30 typically has a pair of spaced apart electrical probes 32 and 34 which function as contacts for an electrical switch. Preparatory to determining the moisture level of the soil probes 32 and 34 are inserted in the soil, which then bridges the physical gap between the probes and accordingly acts as an electrical conductor completing the operating circuit for the prior art indicator device which is contained within the housing 36 of the device 30. As understood, the electrical conductivity of the soil which, as represented by the reference line 38, extends between the two probes is a function of the amount of moisture in the soil; the more moisture, the greater the electrical conductivity. Typically, the soil condition is displayed in reference to a scale 40 and, more particularly, by the position assumed by an indicator or needle 42 along the scale 40. In the embodiment of the prior art device 30 as illustrated in FIG. 4, a very moist condition of the soil 12 will contribute to significant electrical conductivity therein and thus produce a position in the needle 42 along the right-hand portion of the scale 40. If the moisture level of the soil 12 is low, however, there will be but slight movement in the needle 42 and it will therefore essentially remain in its position at the left-hand portion of the scale 40. Naturally, the absence of significant needle movement will dictate that water should be added to the soil 12 while a significant pivotal traverse in the needle 42 will indicate that little or no water need be added to the soil. Once the deivce 30 displays, in the manner just described, the soil condition, the typical prior art use thereof contemplates its removal from the soil 12. Failure to effectuate this removal will result in the running down of the battery which powers the device 30 since it is this battery which provides the energy for the traversing movement in the needle 42 and this energy, in turn, is supplied whether the traversing movement is slight or of a more significant extent.

While device 20, like the prior art device 30, also has spaced apart probes 24 and 26, and these probes also serve as physically separated contacts of an electrical switch, the device 10 can be left implanted in the soil 12 because the flickering or blinking light 22 only occurs, as already noted, when the plant soil 12 dries out and requires a replenishing supply of water. Since this condition, i.e. dryness of the soil, occurs only infrequently, as when after a selected interval of time the initially adequate moisture level of the soil through loss of the plant 10, due to evaporation, and other such causes, recedes to the point where replenishment is necessary, the energy of the powering battery for device 10 is not needlessly wasted. Stated another way, the prevalent condition of the soil 12 is one in which it has enough moisture to favorably promote growth of the plant 10, and thus under these circumstances device 10 is not being battery-powered, for all practical purposes, and thus is not using its energy source, but rather this energy source is only used during the infrequent times when there is excessive dryness in the soil 12. Thus, as related to the normally appropriately moist condition of the plant soil 12, the probes 24 and 26 which are provided at the distal end of the lower depending tapered body section 28 of the device 10 can be accurately characterized as a normally closed electrical switch, which automatically assumes an open or electrically discontinuous condition when the soil which exists in spanning relation between the probes dries out to the extent that it no longer effectively acts as a conductor of electricity. The manner in which this mode of operation is embodied in the device 10 will now be explained in conjunction with the exemplary and preferred electrical circuit illustrated in FIG. 3, to which reference should now be made.

Figure 3:
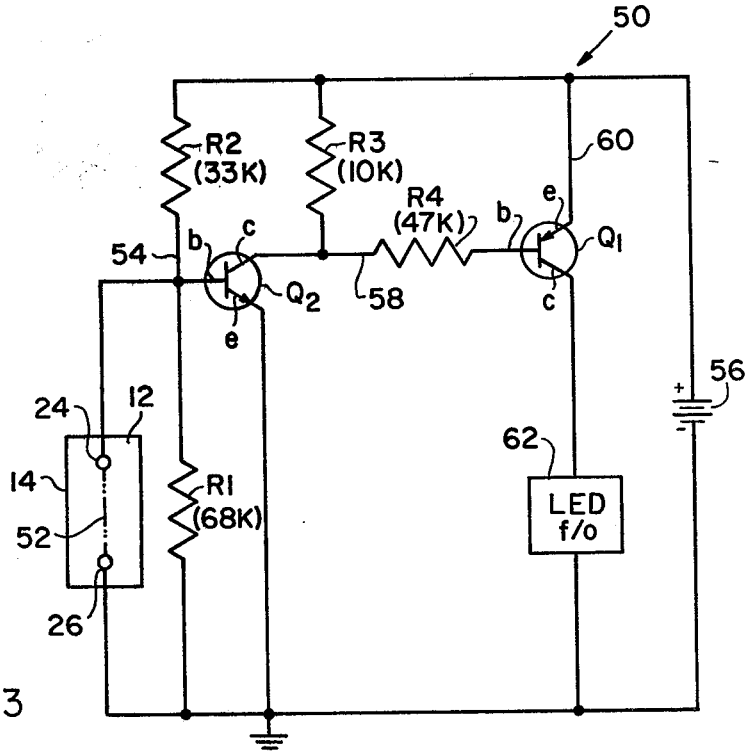
FIG. 3 is a circuit diagram illustrating the electrical components and their cooperative relation in a preferred embodiment of a circuit for operating the within signaling device.

Preliminarily, several well understood operating parameters of electrical circuitry should be recognized in connection with said FIG. 3 circuit, generally designated 50. First, when two unequal resistors are incorporated in parallel, it is generally understood that the effective resistance is slightly less than the smaller of these two resistances. The significance of this will soon be apparent. Second, in the operation of so-called switching transistors, there are three voltages applied, namely a base voltage, a collector voltage and an emitter voltage. Further, a switching transistor, as the name implies, has two operating modes, namely a mode of operation when it is "on" and therefore transmitting current, and an opposite operating condition when it is "off," and thus not effectively conducting current. Lastly, it is well known that a switching transistor will assume its "on" operating mode when the base voltage assumes the value approaching that of the collector voltage and, of course, the reverse is therefore true, namely that the transistor will assume its "off" operating mode when the base voltage moves away from the value of the collector voltage and assumes that of the emitter voltage. Thus, by appropriately varying the base voltage, the so-called switching transistor can either be switched "on" or "off," as the case may be.

Relating the foregoing to circuit 50, it will be noted that the previously noted physically spaced apart probes 24 and 26 are represented as physically spaced apart contacts of an electrical switch. Further, and consistent with the explanation previously provided, in the operative inserted position of these probes 24 and 26 in the soil 12 of the flower pot 14 the electrical cooperative relation of the probes 24 and 26 is one of a closed switch, as represented by the reference line 52 since, as already noted, the initial moisture content of soil 12 is to be assumed and understood to be at a sufficiently high level which is both favorable to the growth of the plant 10 and also effectively promoting electrical conductivity between the spaced apart probes 24 and 26. As a result, the electrical resistance between the probes 24 and 26, as represented by reference numeral 52, and the resistance of R1 in parallel to it, which in a preferred embodiment is 68,000 ohms, denoted as "68k," provides an effective voltage drop which is slightly less than the lesser of the two voltage drops 52 and R1. Since the initially assumed condition is one in which there is significant electric conductivity through the resistance 52, it can be further assumed that this resistance is less than that of the resistance R1. This is significant when related to resistance R2, which will be understood to be of the selected value of 33,000 ohms, denoted as "33k." More particularly, since the voltage drop in the parallel resistors 52 and R1 is determined by the voltage drop through resistance 52 and this is assumed to be, at least initially, of a minimum value because the electric conductivity is high due to the high moisture content of soil 12, it follows that the large voltage drop of the conductor 54 is across the resistance R2. This is but another way of saying that initially the operating condition of the switching transistor Q2 is one in which the base voltage, designated b is of a value approaching that of the emitter voltage, designated e, and thus by definition is far removed from the collector voltage, designated c. Under these assumed conditions, as already noted, resistor Q2 will remain in its "off" operating mode. As a result, the powering battery source 56 of the circuit 50, which in a preferred embodiment may be assumed to be 1.5 volts, delivers a nominal amount of current through the conductor of the circuit 50 which includes the previously referred to resistors R2, R1 and 52. More important, there is no further power demand on the battery 56 since, as noted, transistor Q2 is in its "off" operating mode, and thus constitutes an open switch which effectively prevents current flow to other electrical components of the circuit.

Consideration will now be had of changing conditions, and more particularly the drying out of the plant soil 12 and its effect on the resistance 52. As understood, the loss of moisture in the soil 12 decreases its electrical conductivity and thus in effect increases the electrical resistance of resistor 52. It may be assumed, in fact, that the electrical resistance of resistor 52 ultimately reaches a value where it exceeds that of resistance R1. Thus, the effective resistance of these parallel resistors is ultimately that of the resistor R1 and is approximately 68,000 ohms. The voltage drop therefore across the resistor R1 exceeds that of the resistor R2, which means that in the division of the voltage of the battery 56 in the conductor 54 the major portion thereof is across the resistor R1. This is but another way of stating that the base voltage b is now of a value which approaches that of the collector voltage c which is a condition, as already noted, which results in the transistor Q2 assuming its "on" operating mode. This thus results in the transistor Q2 allowing current flow through the conductor 58 which has the desired and well understood effect of producing a voltage drop across resistor R4 which will be understood to contribute to a base voltage for another switching transistor Q1 which results in this transistor assuming its "on" operating mode. When transistor Q1 switches on, this correspondingly results in current flow from battery 56 through the conductor 60 to a light emitting diode circuit, designated 62 in FIG. 3, which will be understood to be electrically effective to cause intermittent energization and thus flashing of the previously noted light 22. It should be readily recognized that there are many commercially available self-contained so-called LED circuits appropriate for use as the component 62, one such circuit being designated by Model Number LM3909 and available from National Semiconductor Corp. of Santa Clara, Calif.

For completeness' sake, it is noted that the resistance component, designated R3, can be effectively selected to limit the collector current of transistor Q2 and also to improve its switching response. In a preferred embodiment, a value of 10,000 ohms, denoted as "10k," has proved satisfactory. Likewise, the value selected for resistance R4 effectively limits the base current of the transistor Q1 to a minimum value that would still allow full saturation of transistor Q1 when it is turned on and this, in turn, minimizes power consumption by the circuit. In testing and experimentation with circuit 50, it has been found that the typically initial moist condition in the plant soil 12 is one which contributes to a resistance in the resistor 52 of approximately 10,000 ohms. As the soil drys, however, the resistance of course significantly increases. By proper selection of the value of resistance R2 it is possible to prevent transistor Q2 from switching on until the resistance of resistor 52 reaches a value as high as possibly 500,000 ohms. This, of course, is significant in determining the moisture level that the user wishes to have the visual signal 22 commence its operation. For example, it is recommended that a resistance of 22,000 ohms can be selected for the resistor R2 in order to achieve activation of the flashing signal 22 at a comparatively high moisture level, since this will call for frequent watering of such plants as coleus and avocados which require this type of handling. On the other hand, if plant 10 is a cactus, the visual signal 22 should not operate until an extremely low moisture level exists in the soil 12. To achieve this a recommended value of 47,000 ohms should be used for the resistor R2. In the illustrative illustration of circuit 50 illustrated in FIG. 3, the selection of 33,000 ohms for the resistor R2 will be understood to be appropriate to accommodate the vast majority of household plants.

As already noted, a 1.5 volt battery is recommended for the powering battery source 56. Because the flasher 22 is only operated intermittently for a typical plant which needs to be watered perhaps only twice weekly, it has been found that a 1.5 volt battery would theoretically be effective for as long as 36 months. As a practical matter, therefore, the user is not required to make frequent battery changes even though the signaling device 20 hereof has a "permanent" operative position inserted in the plant soil 12, and thus in at least this one significant respect, among others, is readily distinguishable from the contemplated use of the prior art device 30.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A battery powered visual-signaling device for use in normally moist household plant soil for indicating after an interval of time the loss of moisture therefrom to an extent requiring replenishment, said device comprising a battery-operated signaling light means for switching from a normally "off" operating mode to a fully "on" operating mode thereof when the moisture content of the soil has decreased to a predeterminately dry condition such that moisture replenishment is required, a moisture-sensing probe extending in depending relation from said device having an operative inserted position in said plant soil continuously for the duration of said time interval such that initially said normally high moisture content of said plant soil is electrically effective to cause a low resistance condition of said probe and subsequently the gradual diminishment of said moisture content of said plant soil causes a corresponding increase in the probe resistance over a pre-determined range, a fixed resistance of a selected value electrically connected in parallel relation directly across said probe for providing a combined resistance of said probe and fixed resistance which varies as the moisture content of the plant soil correspondingly varies between said high and diminished moisture contents, and a battery-powered control circuit electrically connected with said combined resistance and responsive thereto to produce said "on" operating mode in said signaling light means only in said increased resistance condition of said moisture-sensing probe, the variation of said combined resistance being less than the variation in resistance of said probe alone so as to enabling actuation of said control circuit for relatively abruptly switching said signaling light means between said "on" and "off" operating modes at a desired plant soil moisture content, such that said control circuit requires a minimum of operating battery power in said "off" operating mode of said signaling light means so as to thereby contribute to a more effective duration of operational use of said device and enable continued use of a powering battery over an extended time interval despite the continuous operative inserted condition of said device whereby said device is continuously monitoring and sensing the moisture content of the plant soil to control the actuation of said control circuit for switching said signaling light means.

2. A household plant soil moisture level signaling device as claimed in claim 1 wherein said signaling light means includes a light emitting diode of the type effectively electrically powered by a 1.5 or greater voltage battery.

3. A visual signaling device according to claim 1 wherein said control circuit includes first and second transistor means, said first means having a base, an emitter and a collector and said moisture sensing probe and said fixed resistance being connected between the base and emitter thereof for predeterminately producing an output at the collector as said combined resistance varies with the moisture content of the soil, and said second transistor means having a base, an emitter and a collector, the collector of said first means being connected to the base of said second means for actuating said second means and producing an enabling output at the collector thereof in response to an output signal of said first transistor means, and said signaling light means being connected in series relation to the collector of said second means and being relatively abruptly switched from its "off" to its "on" condition by said enabling output of the second transistor means when the moisture content of the soil has decreased to a predeterminately dry condition along a continuum of values of soil moisture content.

* * * * *